United States Patent [19]

Holdschlag

[11] 4,432,184

[45] Feb. 21, 1984

[54] SUPPORT FOR THE CONSTRUCTION OF BUILDINGS

[76] Inventor: Heinrich Holdschlag, Burloerstrasse 63, D-4280 Borken 1, Fed. Rep. of Germany

[21] Appl. No.: 240,059

[22] Filed: Mar. 4, 1981

[30] Foreign Application Priority Data

Mar. 29, 1980 [DE] Fed. Rep. of Germany ... 8008815[U]

[51] Int. Cl.[3] ..... E04C 3/30

[52] U.S. Cl. ..... 52/732; 52/90; 52/729

[58] Field of Search ..... 52/730–732, 52/720, 90, 92, 93, 650, 729

[56] References Cited

U.S. PATENT DOCUMENTS

| | | | |
|---|---|---|---|
| 1,761,507 | 6/1930 | Williams | 52/732 X |
| 1,818,418 | 8/1931 | Millard | 52/732 |
| 1,842,308 | 1/1932 | Bohnsack | 52/732 |
| 3,333,386 | 8/1967 | Mora | 52/732 X |
| 3,774,344 | 11/1973 | Symons | 52/732 X |

FOREIGN PATENT DOCUMENTS

| | | | |
|---|---|---|---|
| 1134700 | 12/1958 | Fed. Rep. of Germany | 52/730 |
| Ad.56319 | 7/1952 | France | 52/730 |
| 707338 | 5/1966 | Italy | 52/720 |
| 485923 | 3/1970 | Switzerland | 52/730 |

*Primary Examiner*—J. Karl Bell

*Attorney, Agent, or Firm*—Jordan and Hamburg

[57] ABSTRACT

The present invention is directed to a support for sustaining building elements such as joists, trusses, rafters, and purlins, which comprises four corner elements connected to each other by a load-bearing intermediate element, with the distances between the corner elements in one orthogonal direction at least equal to the size of a building element.

15 Claims, 4 Drawing Figures

SUPPORT FOR THE CONSTRUCTION OF BUILDINGS

BACKGROUND OF THE INVENTION

The present invention relates to a support for the construction of buildings by means of joists, trusses, rafters, purlins or similar building elements upheld by a plurality of supports. These supports are four corner elements connected to each other, whose distances from each other in at least one orthogonal direction correspond to at least the thickness of a ceiling beam, rafter, purlin or similar element.

Such supports may be prefinished and allow for construction of houses, halls and similar buildings according to the prefabricating construction principle, wherein the prefabricated building components are assembled at the building site. If so needed, the supports have the advantage that they may run through a plurality of stories and provide for feasible simultaneous connection of ceiling beams, trusses, etc. because these elements may be transversally adjusted through the corner elements.

Supports of this kind are shown, for instance from DE-GM 78 33 451. The corner elements of these supports are connected to each other by arranged facing boards that can be disassembled. In the situation where a ceiling carrier, truss etc. has to be run through the support, the facing boards are disassembled at that location, and the respective ceiling beam or truss is fastened to the corner elements by, for example, bolts.

It was found, though, that such a construction can withstand only small static stresses because the facing boards only exert a connective function between the corner elements and are not normally meant to be carriers. Instead, the prevalent forces and moments are absorbed and deviated by the corner elements. However, dimensions of the corner elements are subjected to limitations given by the construction of the building.

The object of the invention is the creation of a support with characteristics exemplifying improved static properties. The invention solves the task in the previously described support by connecting the corner elements to each other through a load-bearing intermediate element.

SUMMARY OF THE INVENTION

In the support (connector element) formed according to the invention, the corner elements substantially provide only stiffening for the support, so that the forces or moments which occur are principally received through the intermediate element and deviated by it. The ceiling carrier is introduced into the support between the corner elements and thereby comes to rest upon the load-bearing intermediate element so that the transfer of respective forces or moments from ceiling beams to the support occurs. The corner elements extend laterally beyond the ceiling carrier and thereby provide a lateral mounting for it. Thus the corner elements provide, in addition to stiffening function, the task of facilitating the connection of ceiling carriers, trusses, struts and purlins etc. to the support. This effect also covers wall elements, windows and similar building elements, which may also be mounted in the gap between two corner elements upon the support.

The load-bearing intermediate element of a preferred embodiment of the support formed according to the invention is interrupted at places where the ceiling beams, trusses, rafters, purlins and similar building elements have to be passed through the support. In single story buildings, the load-bearing element is formed shorter than the corner elements, so that at the upper end of the support, respective beams, trusses etc. may be interconnected. According to the invention, in the case where the support extends over a plurality of stories so that the corner elements are of the height of at least two stories, the load-bearing intermediate element consists of a plurality of individual elements corresponding to the individual story heights. These individual elements are arranged at distances conforming to the distances of the individual joists. In such a method of construction, the joists are passed into respective interstices between the individual elements so that they lie above the lowest element section. The element section disposed over the lowest section is supported by the joists and may, when so needed, carry additional joists, trusses, struts etc. by itself. Thus the consecutive corner elements of the support in multi-story buildings clearly provide the task of interconnecting the individual sections of the load-bearing intermediate element.

According to the invention, the support is practically formed in a manner so that the load-bearing intermediate element recedes in at least one orthogonal direction relative to the outer side of the corner elements. This construction allows for connection of wall elements, windows and similar building elements to the support, in which case they are urged into the gap present between two proximate corner elements. It is of course reasonable to dimension this gap to such a size so that it conforms to the dimensions of the wall elements, windows etc. The space may also be used to accept conduits, pipes and other installations, according to plans of the building. An embodiment of the invention will naturally be used where such space is available in both orthogonal directions for the connection of wall elements, windows or for accepting conduits, pipes, etc., respectively.

With respect to the size of the distance between the corner elements of the support, a series of possibilities arise depending on the individual function of the support. Thus in one embodiment, the corner elements have distances in both orthogonal directions corresponding to at least the thickness of a joist, truss, rafter, purlin, or similar building element. In this embodiment, the support may hold a joist in both orthogonal directions, which is passed across the respective corner elements. Other embodiments are possible where the distance between the corner elements is dimensioned so that a joist may be passed through the support in one orthogonal direction and in the other orthogonal direction, respective wall elements or windows may be connected as previously described. A particularly advantageous embodiment of the invention excels in providing the corner elements with a distance in one orthogonal direction corresponding to at least the size of a joist and rafter and with a distance in the other orthogonal direction corresponding to at least the size of a purlin. In this embodiment, the load-bearing intermediate element is recessed at the upper end of the support in order to accept the juncture arising from the junction of joist, rafter and purlin. Here the joist extends in an orthogonal direction through the support and rests upon the load-bearing intermediate element. The lower purlin is passed through the support in the other orthogonal direction and rests upon the joist. The rafter is passed in the same orthogonal direction as the joist through the support and is braced against the lower purlin. The corner elements of the support serve as a lateral mounting for the junture consisting of joist, rafter and purlin, and extend to the upper rim of the rafter.

The support according to the invention distinctly allows for the easy arrangement of such junctures at construction sites, in which case the pertinent components may be mostly pre-fabricated. It must be stressed that due to the arrangement of the load-bearing intermediate element, the support is capable of sustaining relatively large respective loads or moments, without requiring excessively large dimensions. The arrangement of the continuous corner elements allows for the construction of supports extending over a plurality of stories, in which case the intermediate elements are interrupted at those places where the load-bearing building elements have to be introduced into the support. Furthermore, besides the stiffening function, the corner elements provide the task of allowing or respectively facilitating the connection of other building elements to the support.

In order to allow the anchoring of the support in a foundation, the load-bearing intermediate element is practically provided between the corner elements with at least one support leg in the lower support area, extending beyond the corner elements. This support leg may be formed, for example, as a flat or U-beam and is easily cemented into the foundation so that the support is solidly secured. Due to the fact that the support leg is arranged between the corner elements, it remains relatively hidden from view and is laterally secured due to the corner elements.

As far as usable building materials for the manufacture of the support are concerned, wood and steel are preferred materials. Wood construction is particularly useful in small buildings, for instance one-family homes, while steel construction is naturally recommended for buildings where larger loads are to be expected, as in halls. Composite structures may also be produced where, for instance, the intermediate element may consist of a steel beam and the corner elements of wood. In all-wood construction, the load-bearing intermediate element and the corner elements are preferably connected by a glued tongue and groove arrangement.

When steel beams are used in a construction, double-T-beams or box-beams is the initial preference. The corner elements and the intermediate element here are preferably welded together, although screw or rivet connections are also possible.

Furthermore, a particularly preferred embodiment of the invention is where the load-bearing intermediate element is a composite material, consisting of a double-T-beam of steel and wood, and where the corner elements consist of wood or steel profiles. In that case, the intermediate element possesses improved supporting strength. The corner elements have recesses into which the flange ends of the double-T-beam are introduced, so that good interlocking between the intermediate element and the corner elements results. The corner elements are generally connected with the wooden parts of the center element. In that construction a diverse variety of connections may be developed for carriers, trusses and joists where, for instance, in the case of a continuous double-T-beam, only the wooden parts of the intermediate element are interrupted for accepting trusses, carriers and joists.

Additional advantages, characteristics and details will result from a description of two embodiments and the drawings as follows.

DETAILED DESCRIPTION OF PREFERRED EMBODIMENTS

Figure 1:
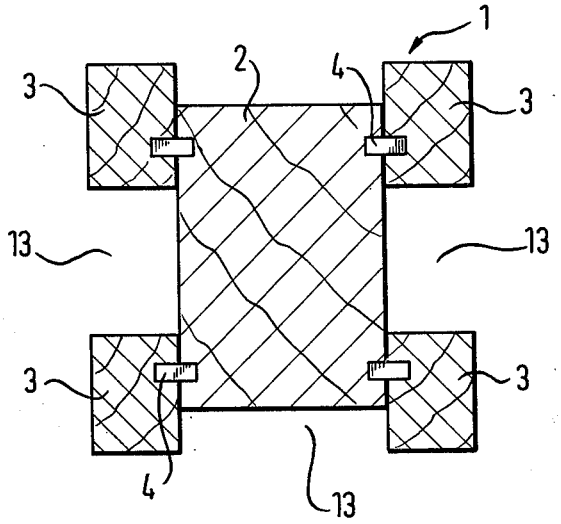
FIG. 1 is a sectional view through a first embodiment of a support, constructed according to the invention.

Support 1, illustrated in cross section in FIG. 1, consists of an intermediate element 2 and four corner elements 3. The intermediate element 2 as well as the corner elements 3 consist of massive all-wood elements, which are glued and fastened to each other by a tongue and groove arrangement 4. The corner elements 3 are arranged relative to the intermediate element 2 so that open spaces 13 result between proximate corner elements. The open spaces 13 serve for connection of other building elements to the support, for instance carriers, binders, rafters, purlins, wall elements, window elements and other construction elements.

The support is substantially constructed or respectively of a size so that the intermediate element 2 serves to substantially sustain the load. The corner elements 3 serve to stiffen the support, or are used as mounting elements for connection to the aforementioned respective building elements. It is of great importance that in those cases where carriers, binders and the like are respectively introduced into or across the support, the intermediate element 2 is interrupted so that these building elements may rest upon the intermediate element, and the corner elements 3 are continuous to thereby form a substantial mounting for the building elements. Even when the support extends over a plurality of stories, the corner elements 3 are continuously formed and the intermediate element 2 is recessed at those places where joists, for instance, have to be passed through the support. Thus the corner elements 3 also assure unity of the intermediate element, in the situation where it consists of a plurality of individual sections. For example, such a support may have a square shape and a width of 25 cm from one corner to the other, with the corner elements having a square cross section and a width of 7 cm.

Figure 2:
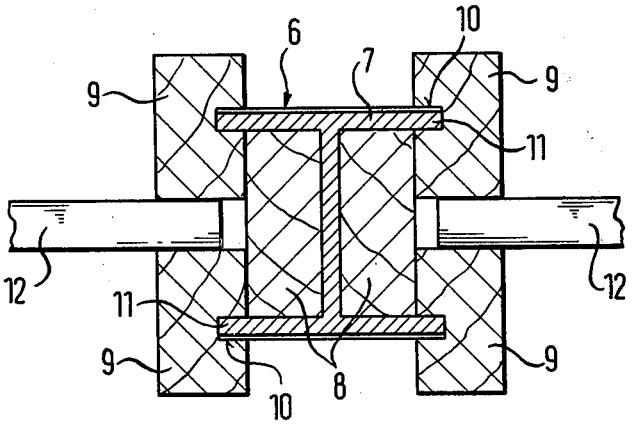
FIG. 2 is a sectional view of a second embodiment of a support, constructed according to the invention, where the support is illustrated as connected to two wall elements.

FIG. 2 illustrates another embodiment of a support 5 according to the invention, also in cross-section. The corner elements 9 of this support are also made only out of wood (laminated wood), and the intermediate element is a composite element consisting of two wooden parts 8 and a double-T-steel beam 7. In this embodiment, the intermediate element 6 has greater loading capacities compared with the embodiment of FIG. 1. The corner elements 9 are provided with recesses 10 into which the flange ends 11 of the double-T-beam 7 extend. This results in good meshing of corner elements 9 and intermediate element 6. Furthermore, the corner elements here are also glued to the wooden parts 8 of the intermediate element. This method does not exclude the use of other methods of combination.

In the embodiment of the support illustrated in FIG. 2, the corner elements 9 are moved together in an orthogonal direction so that the space in between may be used to receive relatively thin wall elements 12. These wall elements 12 are pushed into the interstices and are fastened there in any appropriate fashion. This creates a relatively easy method for fastening wall elements to the support.

Figure 3:
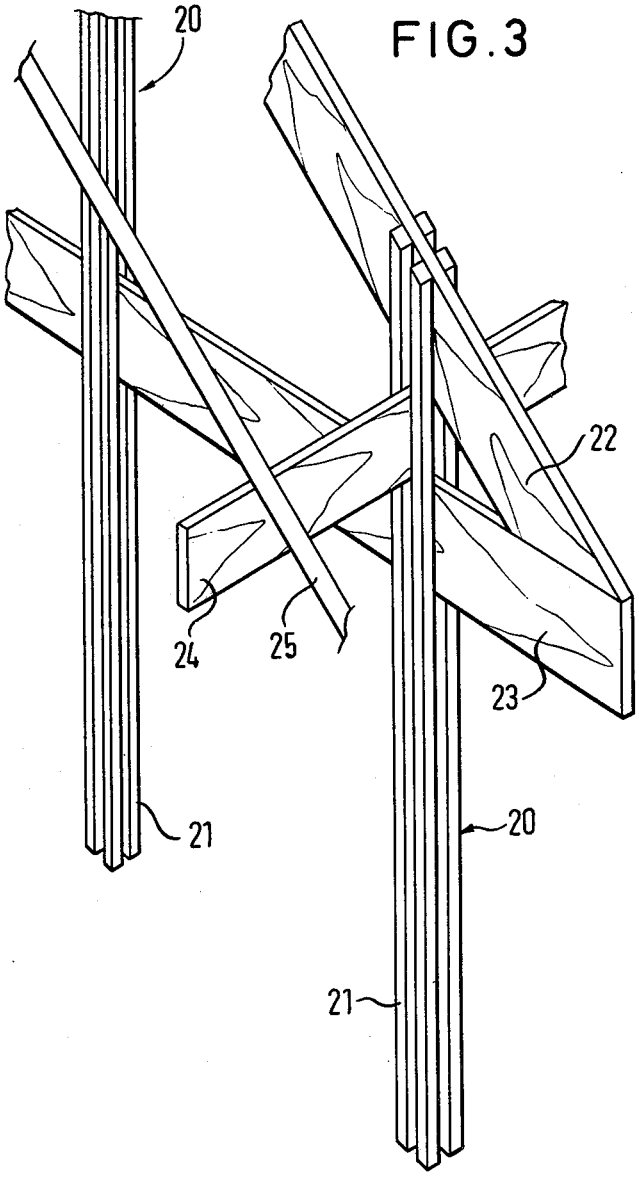
FIG. 3 is a schematic view in perspective of two supports constructed according to the invention which are connected to a ceiling beam, a rafter and a lower purlin.

FIG. 3 is a schematic view of two supports 20 formed according to the invention, when mounted in final position in a single family dwelling. The supports 20 are appropriately anchored in the foundation and divert the respective forces or moments of construction towards it. As viewed in FIG. 3, a continuous horizontal joist 23 is passed through both supports 20 and rests upon both intermediate elements (not illustrated) of the supports. A lower purlin 24 extends perpendicular to the joist 23 and also in a horizontal direction, said lower purlin running through a support 20. The lower purlin 24 rests upon the joist 23. A rafter 22 forms another element and extends underneath the angle of the roof across the support 20 and simultaneously rests upon the lower purlin 24. The rafter 22 supports the elements of the roof, the end of which is illustrated at 25.

FIG. 3 illustrates that the support according to the invention is suitable for accepting the illustrated juncture consisting of joist 23, lower purlin 24 and rafter 22. As mentioned, the intermediate element of the supports extends only up to the joist 23, which rests upon the load-bearing element. The corner elements 21 of the support continue only up to the upper edge of rafter 22. An expert will realize that the construction of the support creates a very simple structure of the juncture-point, upon which respective building elements may be mounted at the construction without any difficulties.

Figure 4:
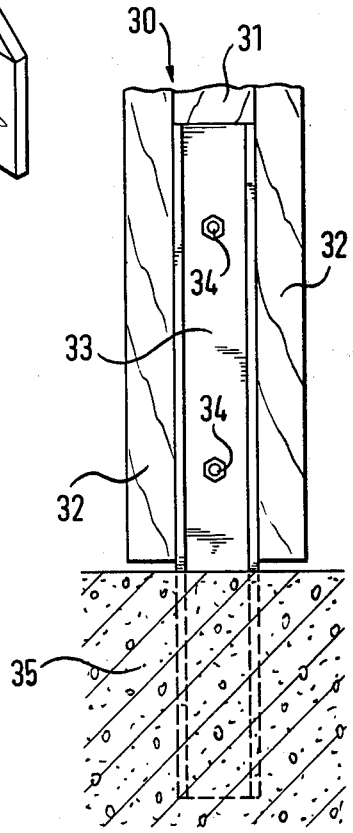
FIG. 4 is a front view of a support leg.

FIG. 4 shows the schematic of the connection of a support 30 to a foundation 35. This connection may be easily accomplished by providing support 30 at its lower end with a support leg 33 which extends beyond the lower end of the support. For this one may use, for example, a U-beam which is screwed to the support as shown at 34. The support leg is thereby fastened only to intermediate element 31 of the support so that it is arranged between two adjacent corner elements 32. This has the advantage that the support leg 32 is relatively hidden and the corner elements 32 additionally retain it in a lateral direction. The lower end of the support leg is cemented in when the support is mounted.

I claim:

1. A support for upholding at least one building element, said support comprising four corner elements, with distances of said corner elements from each other in one orthogonal direction at least the size of the building element, and an intermediate element engaged with each of said four corner elements through a tongue and groove arrangement, said intermediate element receding in at least one orthogonal direction relative to the external side of said corner elements and bearing the load of at least one building element that said support upholds, said four corner elements at least a height of two building stories and said intermediate element being interrupted at a position where the building element is guided across the intermediate element and between the corner elements, the length of one individual segment of said intermediate element substantially equivalent to the height of a respective building story.

2. A support according to claim 1 wherein the corner elements are arranged at distances from each other in both orthogonal directions conforming to at least the thickness of a building element.

3. A support according to claim 1, wherein the corner elements are arranged at a distance conforming in one orthogonal direction to at least the thickness of a joist and a rafter and are arranged at a distance from each other in the other orthogonal direction conforming to at least the thickness of a purlin.

4. A support according to claim 3, wherein the load-bearing intermediate element is recessed in the upper end of the support for the development of a juncture consisting of a joist, a rafter and a purlin.

5. A support according to claim 4 wherein the corner elements and the load-bearing intermediate element are made out of wood.

6. A support according to claim 1 wherein the corner elements are arranged at a distance from each other in one orthogonal direction conforming to at least the thickness of a building element and are arranged at a distance from each other in the other orthogonal direction conforming to at least the thickness of a wall element.

7. A support according to claim 1, wherein the load-bearing element is disposed between corner elements at a lower support end with at least one support leg protruding over the corner elements.

8. A support according to claim 7, wherein the corner elements and the load-bearing intermediate element are made out of steel.

9. A support according to claim 8, wherein the load-bearing intermediate element is a double-T-beam.

10. A support according to claims 8 or 9, wherein the corner elements and the load-bearing intermediate element are welded together.

11. A support according to claim 7, wherein the load-bearing intermediate element and the corner elements are made out of box-beams.

12. A support according to claim 1, wherein the load-bearing intermediate element is a composite element comprising a double-T-beam of steel and wood, with flanges on said double-T beam mating with corresponding recesses in said corner elements.

13. A support according to claim 12 wherein the corner elements are made out of wood.

14. A support according to claim 12 wherein the corner elements are made out of steel.

15. A support according to claim 12 in which the corner elements are additionally glued to the wooden portion of the intermediate element.

* * * * *